United States Patent [19]

Shaull et al.

[11] 4,190,000

[45] Feb. 26, 1980

[54] MINE PROXIMITY FUSE

[75] Inventors: John M. Shaull, Bethesda, Md.; Godfrey R. Gauld, Seattle, Wash.; Lawson E. Richtmyer, Silver Spring, Md.

[73] Assignee: The United States of America as represented by the Secretary of the Army, Washington, D.C.

[21] Appl. No.: 232,924

[22] Filed: Oct. 23, 1962

[51] Int. Cl.[2] ..... F42B 23/00

[52] U.S. Cl. ..... 102/19.2

[58] Field of Search ..... 102/18, 19.2, 70.2, 102/70.2 P, 70.2 G, 211

[56] References Cited

U.S. PATENT DOCUMENTS

| | | | |
|---|---|---|---|
| 2,958,280 | 11/1960 | Gilfillan et al. | 102/18 |
| 2,966,853 | 1/1961 | Gilfillan, Jr. et al. | 102/18 |
| 2,993,440 | 1/1961 | Chubb et al. | 102/18 |
| 2,997,647 | 8/1961 | Gaugler et al. | 102/18 |
| 3,094,929 | 6/1963 | McGinley et al. | 102/18 |
| 3,125,953 | 3/1964 | Foerster | 102/18 |

*Primary Examiner*—Charles T. Jordan

*Attorney, Agent, or Firm*—Nathan Edelberg; Robert P. Gibson; Saul Elbaum

EXEMPLARY CLAIM

1. A proximity fuze for a stationary mine comprising:
   (a) a power supply;
   (b) a vibration sensitive switch having a stationary contact and a vibratory contact, one of said contacts being connected to said power supply;
   (c) an LC ringing circuit connected to the other of said contacts, said vibration sensitive switch intermittently conducting current from said power supply to said LC ringing circuit when activated by vibrations in the region of said mine thereby setting up a series of exponentially decaying sinusoidal oscillations in said LC ringing circuit;
   (d) a magnetometer connected to said LC ringing circuit and excited by the sinusoidal oscillations produced thereby; and
   (e) amplitude discriminating circuit means connected to said magnetometer for producing a firing pulse when the output of said magnetometer exceeds a predetermined value.

4 Claims, 7 Drawing Figures

MINE PROXIMITY FUSE

The invention described herein may be manufactured and used by and for the Government of the United States of America for governmental purposes without the payment to us of any royalty thereon.

This invention relates to the field of fuzes and more particularly to the field of mine proximity fuzes.

Object proximity detectors form one well-known class of devices for detonating mines. Such detectors rely for their operation on some property of the target object. Previous devices have made use of such of these properties as vibration, magnetic premeability and induction. These devices function reasonably well but each type has its own peculiar shortcomings. For example, vibration sensors are extremely difficult to adjust accurately enough to enable them to distinguish between nearby military vehicles and earth tremors caused by explosions, and, in some cases, these devices even become responsive to footsteps. Electric and magnetic-field sensing devices exhibit greater target discrimination than the vibration sensors, but they have a limited lifetime because they require a continuous supply of electrical energy and the power supplies which can be conveniently stored in a mine case have a limited operating life.

It is therefore an object of this invention to provide target detection with a high degree of discrimination.

It is still another object of this invention to provide for ambient field compensation in a magnetic target detector.

According to one form of this invention a novel combination of both vibration sensing and magnetic field sensing means are provided in a mine fuze. These elements are so connected that the power supply to the magnetic detector is inactive until the vibration detecting means is triggered, thereby activating the magnetic sensing means. In this way, the active life of the magnetic sensor power supply is extended while the effect of the poor target discrimination characteristic of vibration sensors is nullified. Ambient magnetic field compensation is achieved either manually or automatically by means of a compensating magnetic field created in the vicinity of the magnetic field sensor.

These and other objects of this invention will be better understood by reference to the following description taken in connection with the drawings wherein.

Figure 1:
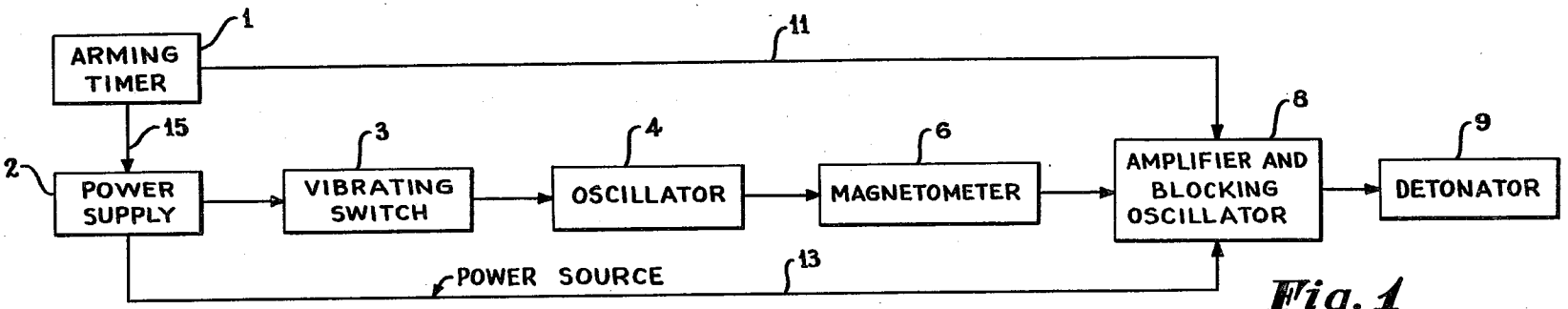
FIG. 1 is a block diagram of a preferred embodiment of the present invention.

Turning now to FIG. 1, there is shown a block diagram of a mine fuze constructed according to this invention. The fuze is rendered operative by an arming timer 1 which is preset to close one or more switches at the end of a timing interval. This timer 1 can be of any well known type, such as a commercially available industrial timer adapted to close one or more switches at the end of its timing interval. One of the switches thus closed serves to place a power supply 2 in an armed condition. Other switches controlled by the timer could be inserted in other of the circuits of the fuze so as to place them in armed condition. It should be understood that, although any number of switches might be provided, a single switch in the power supply will be sufficient to achieve the necessary safety, if the system is operating properly. The power supply 2 might be a 6-volt mercury battery, or a lower voltage battery, in which case a D-C voltage converter or amplifier would have to be employed in connection with the lower voltage battery so as to produce a sufficient voltage to fire the explosive detonator. The output of power supply 2 is connected to a vibration sensitive switch 3 which responds to vibrations in the vicinity of the fuze in such a manner as to pulse modulate the output of the power supply 2. The pulses produced at the output of the vibrating switch 3 trigger an oscillator 4 which then produces a train of sine waves for each pulse input. The oscillator is designed to produce sine waves for the proper frequency for operating the magnetic flux detecting magnetometer 6. The magnetometer 6 is provided with a zeroing means which serves to nullify the effect of any ambient magnetic field, so that the magnetometer only produces an output when some external magnetic influence has entered the magnetometer field. When this influence is large enough to indicate the presence of a particular type of vehicle, such as a tank, the amplitude of the magnetometer output is sufficient to trigger an amplitude discriminator 8 which in turn provides the necessary voltage for initiating the action of the detonator 9. The discriminator 8 may be of any well known type which is capable of producing a voltage pulse upon receipt of a preselected amplitude input voltage. For example, a blocking oscillator or a one-shot multivibrator may be used in this circuit.

Figure 2:
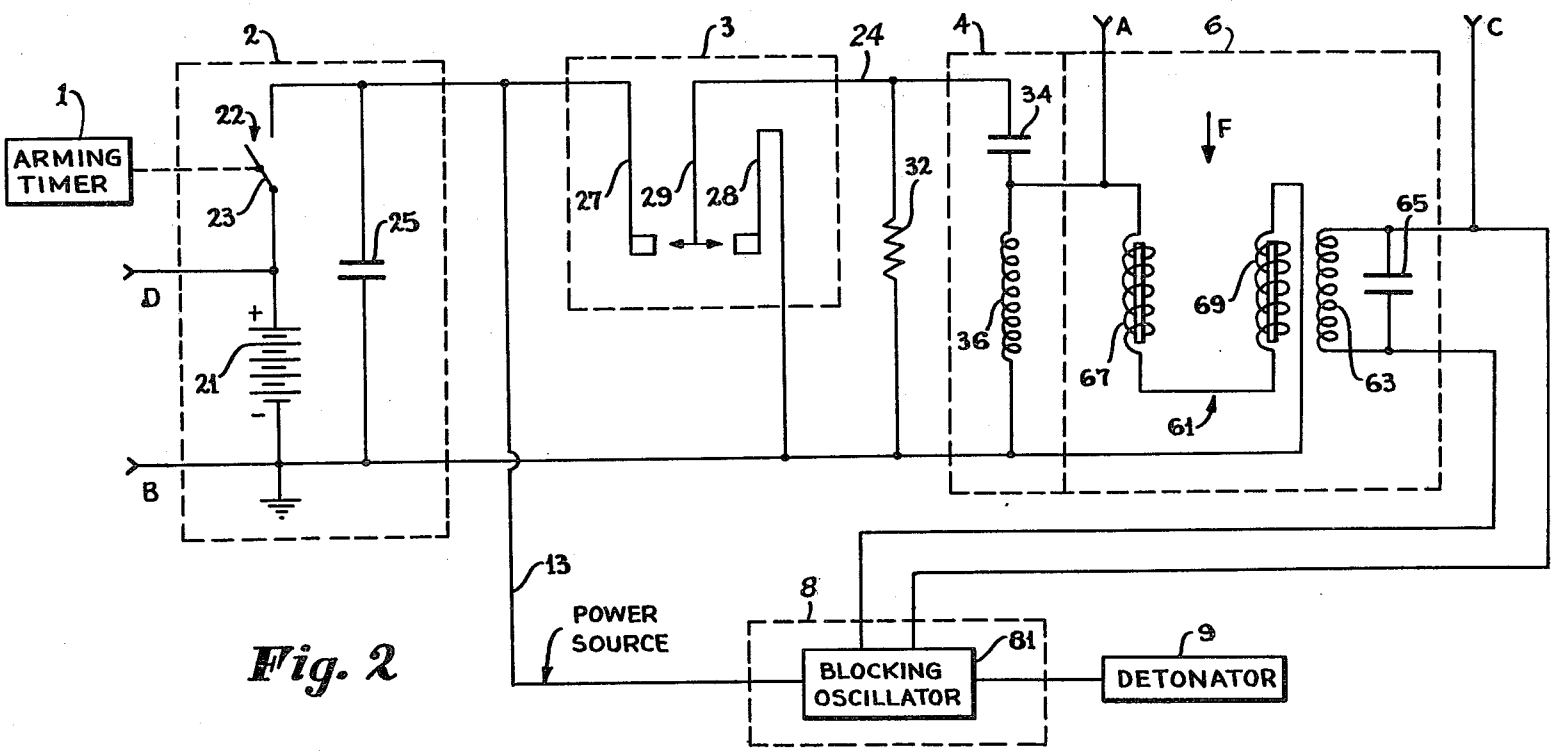
FIG. 2 is a schematic diagram of a portion of the circuit of of FIG. 1.

Turning now to FIG. 2, there is shown a circuit diagram illustrating preferred forms of the various elements indicated in block form in FIG. 1. The power supply 2 may comprise simply a battery 21, which can be of the mercury type, and a storage capacitor 25. A switch 22 having a movable contact 23 is connected in series with the battery. This switch is closed at the end of the operating time of the timer 1, connecting the output of power supply 2 to one stationary contact 27 of the vibration detector 3. The other stationary contact 28 of the detector is connected to electrical ground. The vibrating reed 29 is excited into vibration by any disturbance in the surrounding medium and vibrates between the contact arms 27 and 28, thus causing a series of electrical pulses to be conducted along the arm of reed 29, which arm is made of a conducting material, so that the pulses appear at output terminal 24 of detector 3. Other types of vibrating detectors may be used, such as vibrating variable reluctance systems, or a vibrating reed system which transfers its vibrating energy to a high frequency tuning fork, with the frequency of the tuning fork being converted to a sine wave signal by the variable reluctance technique. If this latter system is used, a separate oscillator 4 need not be employed.

The output of detector 3 is impressed across a resistor 32 and an oscillating circuit 4. The resistor 32 is merely a backup device to insure that the oscillating circuit can discharge in preparation for the next input pulse in the event that reed 29 fails to contact ground contact 28. The oscillator 4 of FIG. 2 is a simple LC ringing circuit, having the values of its components so selected that the ringing frequency is that required to operate the magnetometer 6. In addition to the ringing circuit shown, a shunt-excited LC circuit could also be employed as the oscillating circuit. The output of oscillator 4 is taken across the inductor 36 and is applied to the primary coils 61 of magnetometer 6. The primary 61 comprises a pair of coils 67 and 69 having high permeability cores. Each of these primary windings impresses a voltage on the secondary winding 63, the polariy of the voltage impressed on coil 63 by primary 67 being opposite to that of the voltage created by primary 69. As long as there is no external flux affecting the cores of the primary winding, the total voltage impressed on coil 63 will be zero. However, when there is a flux component parallel to these cores, the net voltage impressed on secondary 63 will not be zero, but will be a signal at the second harmonic frequency of the drive voltage and having an amplitude which is proportional to the magnitude of the applied field. The operation of such a magnetometer is fully described in Magnetic-Amplifier Circuits by Geyger (1954), at pages 226–27, and need not be discussed in greater detail here. When an object such as a tank passes in the vicinity of the magnetometer 6 it generates a component F of flux in a direction parallel to the cores of the primary windings 67 and 69, thus causing a second harmonic voltage to be generated across winding 63. A capacitance 65 across winding 63 resonates winding 63 at twice the frequency of oscillator 4. When the secondary voltage becomes large enough, it triggers the amplitude discriminator circuit 8, causing a firing pulse to be impressed on the firing circuit 9. The amplitude discriminator 8 may consist of a transitorized blocking oscillator 81 or a transitorized multivibrator or a combination of the two. These circuits may receive their sources of operating power from the battery 21. A form of transitorized blocking oscillator which may be used in this device is shown in Semiconductor Devices and Applications by R. A. Greiner (1961), at page 398, FIGS. 20–21. If this circuit were used, the two inputs to the blocking oscillator from magnetometer 6 would be connected to the base and the emitter, respectively, of the blocking oscillator. The multivibrator may be of the monostable type, similar to that shown in FIG. 20—20 at page 379 of Greiner, supra. Both of these circuits are well known in the art and need not be discussed in greater detail here. The firing circuit 9 could be any well known type of commercially available electrically operated detonator.

Figure 3:
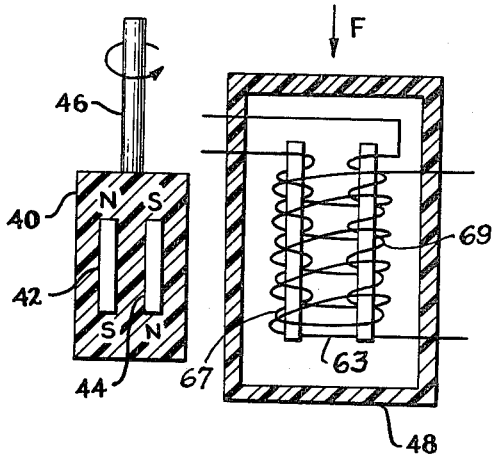
FIG. 3 is a plan view of a magnetometer useful in this invention along with a preferred form of manual ambient field compensating system.

Turning now to FIG. 3, there is shown one form of ambient field compensating means. A magnetometer coil assembly 48 is shown in which the primary coils 67 and 69 are wound about their respective cores in close proximity to each other. The secondary winding 63 encloses both primary windings so as to insure a good flux linkage. This system is responsive to a flux field in the direction of the arrow F, so that when an ambient magnetic field has a component in this direction, the fuze will detect it. The effect of this field on the magnetometer should be eliminated so that the fuze will be sensitive to disturbances in the magnetic field caused by the approach of target objects. One means for effecting this cancellation of the ambient magnetic field consists of a manual zeroing assembly 40 which contains two permanent bar magnets 42 and 44. The magnet 42 creates a flux in one direction while the magnet 44 creates a flux in the other direction. When the zeroing assembly is in the position shown in FIG. 3, magnet 44 has a greater effect on the magnetometer 48 than does the magnet 42, so that the zeroing means 40 impresses a component of flux on the magnetometer 48 which has the same polarity as the flux in magnet 44. The zeroing assembly is provided with a shaft 46 which is adapted to rotate the assembly 40 about a vertical axis, and which has a notch in its upper end (not shown) which is adapted to receive a screwdriver. The upper end of this shaft extends outside of the case of the mine so that an operator can rotate it with a screwdriver after the mine has been emplaced. When the unit 40 is rotated 90 degrees from the position shown in FIG. 3, the magnets 42 and 44 are equidistant from the coils of magnetometer 48 so that the zeroing assembly 40 provides no flux compensation to the magnetometer 48. When the unit 40 has been rotated 180 degrees from the position shown in FIG. 3 the magnet 42 has a predominant effect on the magnetometer 48, so that it provides a correcting flux of the opposite polarity from that provided when the assembly 40 is in the position shown in FIG. 3. Thus it may be seen that the zeroing assembly 40 is capable of providing a flux which can nullify an ambient flux having either polarity. When the manual zeroing device of FIG. 3 is utilized, the circuit of FIG. 2 would be modified to include an electrical connector at the top of the mine which would be accessible after the mine had been emplaced but before the mine had been covered with earth. This connector would contain leads from the output of battery 21, and the inputs and outputs of magnetometer 6. An auxiliary circuit containing an oscillator, a voltage measuring device and a mating connector for the mine connector would be provided. When the two connectors are joined, the battery 21 of the mine would activate the oscillator in the auxiliary circuit, the output of the auxiliary oscillator would excite the magnetometer 6 and the output of the magnetometer would be connected to the auxiliary circuit voltage measuring means. The shaft 46 of the manual zeroing device would then be rotated until it reached a position where the output of the magnetometer 6 was zero. The zeroing device 40 would then be in a position where it exactly nullified any ambient field in the vicinity of the detector. The auxiliary circuit would then be disconnected and the mine fuze would be in adjustment for proper operation.

Figure 4:
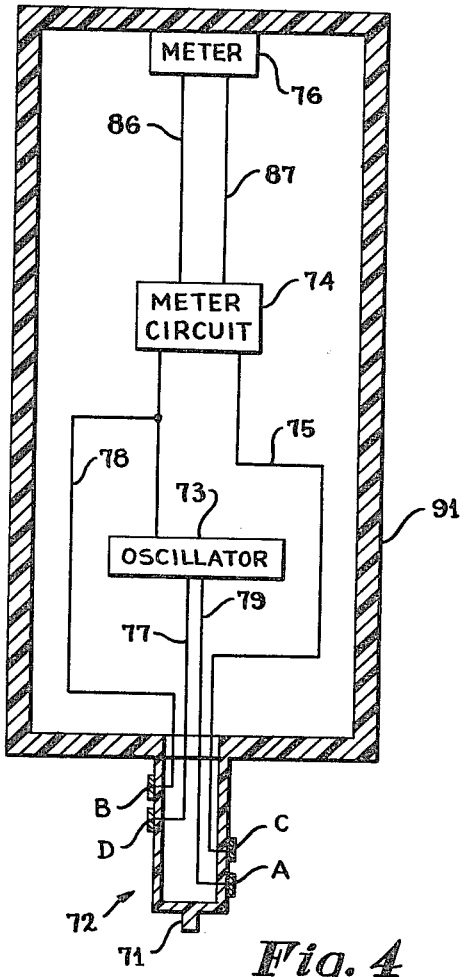
FIG. 4 is a block representation of a preferred form of field compensation adjustor.

FIG. 4 illustrates one form which the manual adjusting unit may take. In this figure there is shown a cross sectional view of a combination auxiliary circuit and zeroing device. This device contains a shaft 72 on the end of which is a screwdriver tip 71 which is adapted to mate with the notch in shaft 46 of the zeroing device shown in FIG. 3. The shaft 72 is rigidly fastened to case 91, and has a series of circumferential slip ring connectors A, B, C and D. The mine would be equipped with a suitable cylindrical jack having four connectors adapted to mate with the connectors on shaft 72. At the bottom of this jack, the slotted end of shaft 46 is positioned so as to mate with the screwdriver tip 71 of the unit of FIG. 4. The contacts on the jack are connected to the leads illustrated in FIG. 2 so that when the units are connected those leads would make contact with the similarly labeled contacts on the shaft 72. When this connection is made, the ground terminals of the meter circuit 74 and the oscillator 73 are connected through lead 78 to contact B, the input 77 to the oscillator 73 is connected to the battery 21 of FIG. 2, the output 79 of oscillator 73 is connected through connector A to the input of the magnetometer 6, and the input 75 of meter circuit 74 is connected through connector C to the output of magnetometer 6. The output terminals 86 and 87 of meter circuit 74 are connected to meter 76. Meter 76 could be any conventional type of current sensitive meter having a suitable current range. When the entire unit of FIG. 4 is rotated, the zeroing unit 40 of FIG. 3 is rotated and the meter 76 registers the output of magnetometer 6. When the meter reading is zero, the proper adjustment has been made; the unit of FIG. 4 may be withdrawn from the jack, and the mine is ready for operation. The meter circuit 74 may be of any type which is adapted to modify the output of magnetometer 6 so as to provide a usable signal for meter 76.

Figure 5:
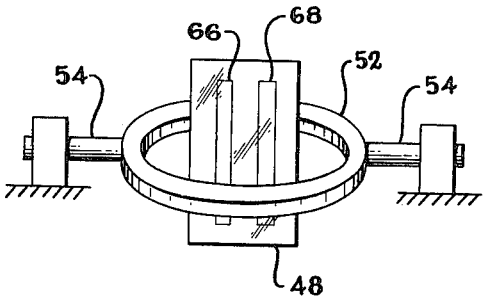
FIG. 5 is a side view illustrating a magnetometer automatic field compensating unit.

Ambient field correction may also be achieved by the use of automatic field compensating devices. Such a device is depicted in FIG. 5 wherein is shown the case 48 of a magnetometer surrounded by a ring magnet 52. This magnet is supported by two torsion wires 54 which, in turn, are rigidly fastened to an external case (not shown) which case also rigidly supports the magnetometer 48. The entire magnetometer and ring magnet assembly are surrounded by a viscous fluid which tends to damp the motion of the magnet, so that the magnet will respond to constant amplitude ambient magnet fields but will be unresponsive to rapid magnetic field variations caused by the approach of a target object.

Figure 6:
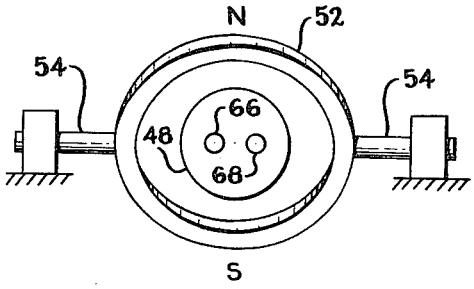
FIG. 6 is a top view of the structure of FIG. 5.

FIG. 6 illustrates a top view of the assembly of FIG. 5. This view illustrates that the ring magnet 52 surrounds the magnetometer assembly 48, and when the magnet 52 is undeflected its field is perpendicular to the axis of the magnetometer windings, so that the magnet 52 in the undeflected state has no effect on the flux in these windings. The magnetometer is of course only responsive to flux fields having a component parallel to the axes of the magnetometer cores 66 and 68. When such a flux component exists it will create a torque on the ring magnet 52 which will cause the magnet to be deflected from its position normal to the magnetometer cores 66 and 68. The magnet 52 has a field between its poles which is in the space enclosed by its circumference. When this magnet is deflected a component of that field will be parallel to the magnetometer axis. That field will be opposite in polarity to the external field causing the magnet deflection. If the restoring torque constant of the wires 54 is properly selected, the field component created by the magnet will exactly nullify the ambient magnetic field. This may be seen by reference to FIG. 7 wherein is shown a diagram illustrating the various magnetic field vectors involved.

Figure 7:
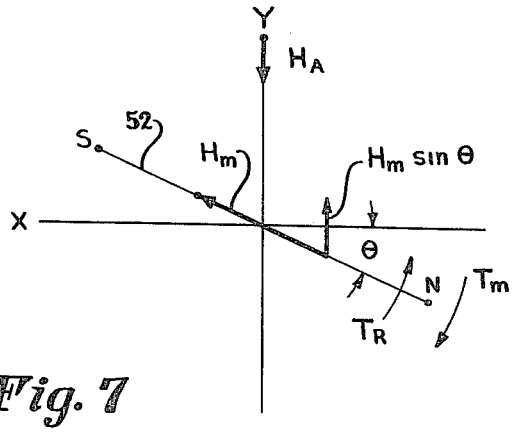
FIG. 7 is a vector diagram of the magnetic fields affecting the magnetometer of FIG. 5.

In FIG. 7, X represents the horizontal axis and Y represents the vertical axis with the origin of the axes lying in the plane described by the ring magnet 52, at the center of the circle formed by the magnet. When the magnet is undeflected, it lies in the horizontal plane. The magnetometer cores are arranged parallel to the vertical axis. An ambient magnetic field $H_A$ is shown along the vertical axis. This field would tend to cause the magnet 52 to deflect through a small angle $\theta$ in such a direction that that portion of the field $H_m$ of the magnet which acts upon the magnetometer 48 tends to oppose the ambient magnetic field. The component of the field of the magnet $H_m$ parallel to the ambient field would then be equal to $H_m \sin \theta$. The torque $T_m$ acting on the magnet 52 because of the ambient field $H_A$ is given by:

$$T_m = H_A \times M \tag{1}$$

where M is the magnetic moment of the magnet 52.

The restoring torque $T_R$ produced by the wires 54 when they experience a twisting force is equal to:

$$T_R = K\theta \tag{2}$$

where K is the torque constant of the wires 54 and $\theta$ is the total angular rotation of each of the wires. The magnet will come to rest at a position where the torque created by the ambient magnetic field is exactly balanced by the restoring torque produced by the wires 54, or:

$$T_m = T_R \tag{3}$$

Substituting equations (1) and (2) into equation (3) yields:

$$H_A M = K\theta \tag{4}$$

But, as may be seen from observation of FIG. 7, when the magnet is rotated through some angle $\theta$, the ambient field will be just cancelled if $$H_A = H_m \sin \theta \tag{5}$$

or, since $\theta$ will be a small angle, the following simplification may be used:

$$H_A = H_m \theta \tag{6}$$

If the restoring torque constant K of the wires can be properly selected, it would seem that just the proper rotation $\theta$ would be produced which would satisfy equation (6). Since equation (4) is an equality which represents the actual equilibrium condition of the magnet 52, while equation (6) represents the desired condition, the desired condition will be created if K can be selected so that equation (4) satisfies equation (6). Rearranging equation (4):

$$H_A = \frac{K\theta}{M} \tag{7}$$

Equating (6) and (7):

$$\frac{K\theta}{M} = H_m \theta \tag{8}$$

or, $$K = H_m M \tag{9}$$

Thus, it may be seen that by selecting wires 54 which have a restoring torque constant $H_m M$, the desired automatic ambient field correction will be obtained.

The restoring torque could also be provided by an auxiliary magnetic field $H_R$ parallel to the X axis. This field would create the torque $T_R$, which torque would be equal $H_R M \sin \theta$, or simplified, $H_R M \theta$, for small values of $\theta$. When magnet 52 achieves equilibrium, the following equality exists:

$$H_A M = H_R M \theta \tag{10}$$

However, equation (6) must still be satisfied, so it is necessary that:

$$(H_m\theta)M = H_R M\theta \quad (11)$$

or, $$H_R = H_m$$

This fully establishes the value needed for the auxiliary or restoring field.

While the invention has been described with reference to several embodiments, which give satisfactory results, it will be understood by those skilled in the art to which this invention pertains that various changes and modifications may be made without departing from the spirit and scope of the invention, and it is our intention therefore, to cover in the appended claims, all such changes and modifications.

We claim as our invention:

1. A proximity fuze for a stationary mine comprising:
(a) a power supply;
(b) a vibration sensitive switch having a stationary contact and a vibratory contact, one of said contacts being connected to said power supply;
(c) an LC ringing circuit connected to the other of said contacts, said vibration sensitive switch intermittently conducting current from said power supply to said LC ringing circuit when activated by vibrations in the region of said mine thereby setting up a series of exponentially decaying sinusoidal oscillations in said LC ringing circuit;
(d) magnetometer connected to said LC ringing circuit and excited by the sinusoidal oscillations produced thereby; and
(e) amplitude discriminating circuit means connected to said magnetometer for producing a firing pulse when the output of said magnetometer exceeds a predetermined value.

2. A proximity fuze for a stationary mine as recited in claim 1 further including a manually adjustable ambient magnetic field compensating assembly comprising:
(a) two permanent bar magnets oriented parallel to the direction of magnetic flux sensitivity of said magnetometer, opposite poles of said bar magnets being adjacent; and
(b) rotatable support means upon which said bar magnets are mounted symmetrically about the axis of rotation of said support means, said support means being positioned in close proximity to said magnetometer whereby said magnetometer may be subjected to a correcting magnetic flux of the desired magnitude and polarity to compensate for an ambient magnetic field by rotation of said support means.

3. A fuze as recited in claim 1 wherein said magnetometer includes an automatic ambient magnetic field compensating means, said automatic field compensating means comprising a circular ring magnet surrounding said magnetometer and supported at two opposite points each of which points is midway between the poles of said magnet.

4. A fuze as recited in claim 3 wherein said magnet is supported by a pair of torsion wires.

* * * * *